US011015388B2

(12) United States Patent
Chen et al.

(10) Patent No.: US 11,015,388 B2
(45) Date of Patent: May 25, 2021

(54) LADDER CORD FASTENING SEAT FOR NON-PULL WINDOW BLIND

(71) Applicant: SHEEN WORLD TECHNOLOGY CORPORATION, Taichung (TW)

(72) Inventors: Hung-Hao Chen, Taichung (TW); Ming-Che Tsai, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 199 days.

(21) Appl. No.: 16/175,934

(22) Filed: Oct. 31, 2018

(65) Prior Publication Data

US 2019/0128062 A1 May 2, 2019

(30) Foreign Application Priority Data

Oct. 31, 2017 (TW) ..... 106137671

(51) Int. Cl.
*E06B 9/323* (2006.01)
*E06B 9/382* (2006.01)
*E06B 9/32* (2006.01)

(52) U.S. Cl.
CPC ..... *E06B 9/382* (2013.01); *E06B 9/32* (2013.01); *E06B 9/323* (2013.01)

(58) Field of Classification Search
CPC ..... E06B 9/303; E06B 9/304; E06B 9/305; E06B 9/306; E06B 9/307; E06B 9/308; E06B 9/32; E06B 9/382; E06B 9/323; E06B 9/384
USPC ..... 160/368.1
See application file for complete search history.

(56) References Cited

U.S. PATENT DOCUMENTS 3,333,905 A * 8/1967 Hennequin ..... E06B 9/322 384/440
4,411,401 A * 10/1983 Anderson ..... E06B 9/323 248/251
5,522,444 A * 6/1996 Liu ..... E06B 9/323 160/178.1 R
5,638,882 A * 6/1997 Morris ..... E06B 9/308 160/176.1 R
6,761,203 B1 * 7/2004 Huang ..... E06B 9/322 160/170
8,925,615 B2 * 1/2015 Lin ..... E06B 9/322 160/170
2002/0174961 A1 * 11/2002 Anderson ..... E06B 9/262 160/178.1 R
2003/0178155 A1 * 9/2003 Fraczek ..... E06B 9/303 160/170
2006/0000562 A1 * 1/2006 Liu ..... E06B 9/32 160/173 R
2008/0135191 A1 * 6/2008 Zakowski ..... E06B 9/50 160/181

(Continued)

*Primary Examiner* — Daniel P Cahn
(74) *Attorney, Agent, or Firm* — Browdy and Neimark, PLLC

(57) ABSTRACT

A ladder cord fastening seat for a non-pull window blind includes two vertical posts located opposite to each other and an arc bridge. The ladder cord fastening seat is fastened in a top beam through the two vertical posts. Each of the vertical posts has a cord inserting hole for a ladder cord to be inserted therethrough. The arc bridge is used for fastening the ladder cord. The arc bridge connects the two vertical posts in such a way that an accommodation space is defined to accommodate a transmission member located in the top beam.

6 Claims, 4 Drawing Sheets

(56) References Cited

U.S. PATENT DOCUMENTS

| | | | | |
|---|---|---|---|---|
| 2010/0186907 | A1* | 7/2010 | Kraler | E06B 9/307<br>160/176.1 P |
| 2011/0030906 | A1* | 2/2011 | Trettin | A47H 1/02<br>160/368.1 |
| 2013/0048234 | A1* | 2/2013 | Dahl | E06B 9/388<br>160/171 |
| 2016/0076303 | A1* | 3/2016 | Liu | E06B 9/323<br>242/398 |
| 2016/0222722 | A1* | 8/2016 | Schulman | E06B 9/68 |
| 2017/0292322 | A1* | 10/2017 | Chen | B65H 75/4471 |
| 2018/0328108 | A1* | 11/2018 | Chou | E06B 9/28 |
| 2019/0048655 | A1* | 2/2019 | Lin | E06B 9/305 |
| 2019/0128061 | A1* | 5/2019 | Slobbe | E06B 9/322 |
| 2019/0352961 | A1* | 11/2019 | Chen | E06B 9/32 |

* cited by examiner

LADDER CORD FASTENING SEAT FOR NON-PULL WINDOW BLIND

BACKGROUND OF THE INVENTION

1. Field of the Invention

The present invention relates to non-pull window blinds and more particularly, to a ladder cord fastening seat for the non-pull window blind.

2. Description of the Related Art

Common window blinds, such as Venetian window blinds, structurally includes a top beam, a bottom beam, and a plurality of slats. The slats are parallel suspended between the top and bottom beams by two ladder cords. Under the synchronous control of the two ladder cords, the slats will turn properly, so that the indoor lighting can be adjusted at any time.

However, the aforesaid two ladder cords are generally disposed at left and right ends of the slats, so the slats is likely to twist especially when the slats are adjusted to the vertical condition. In order to improve the aforementioned twist phenomenon, one additional ladder cord (i.e. the third ladder cord) may be fastened to the middle of the slats for assisting the left and right ladder cords to turn the slats, the third ladder cord, when being fastened to the top beam, may interfere with the transmission components in the top beam, such as the cord rolling device, thereby increasing the difficulty of installation.

SUMMARY OF THE INVENTION

It is an objective of the present invention to provide a ladder cord fastening seat for non-pull window blind, which enables the ladder cord to be fastened at the middle of the window blind without interfering the existing components of the window blind.

To attain the above objective, the present invention provides a ladder cord fastening seat which includes two vertical posts located opposite to each other, and an arc bridge. Each of the vertical posts has a cord inserting hole for a ladder cord to be inserted therethrough. The arc bridge connects the two vertical posts in such a way that an accommodation space is defined by the two vertical posts and the arc bridge.

It can be understood from the above illustration that the ladder cord fastening seat of the invention may be installed in a top beam by the two vertical posts. After the installation, owing that the accommodation space is spared, the ladder cord fastening seat can crossover the transmission components existed in the top beam, such as the cord rolling device. In this way, the ladder cord fastening seat enables the ladder cord to be fastened at the middle of the window blind without interfering the existing structure of the window blind.

Preferably, each of the vertical posts has two positioning walls located opposite to each other, a bottom wall, and an end wall; the bottom wall connects bottom ends of the two positioning walls and has said cord inserting hole; the end wall connects the two positioning walls and the bottom wall; the arc bridge has two first bridging portions located opposite to each other and a second bridging portion connecting the two first bridging portions; each of the first bridging portions connects the positioning walls of the two vertical posts; the second bridging portion connects the end walls of the two vertical posts.

Preferably, each of the positioning walls of the vertical posts is provided on the top end thereof with a positioning recess; each of the bottom walls of the vertical posts is provided on a bottom surface thereof with a positioning protrusion. In this way, the ladder cord fastening seat can employ the positioning recesses and the positioning protrusions to engaged with the top beam.

Preferably, each of the end walls of the vertical posts has a guiding groove communicating with the cord inserting hole, so that two ends of the ladder cord can be pulled to the top surface of the second bridging portion of the arc bridge along the guiding grooves respectively and tied there.

DETAILED DESCRIPTION OF THE INVENTION

Figure 3:
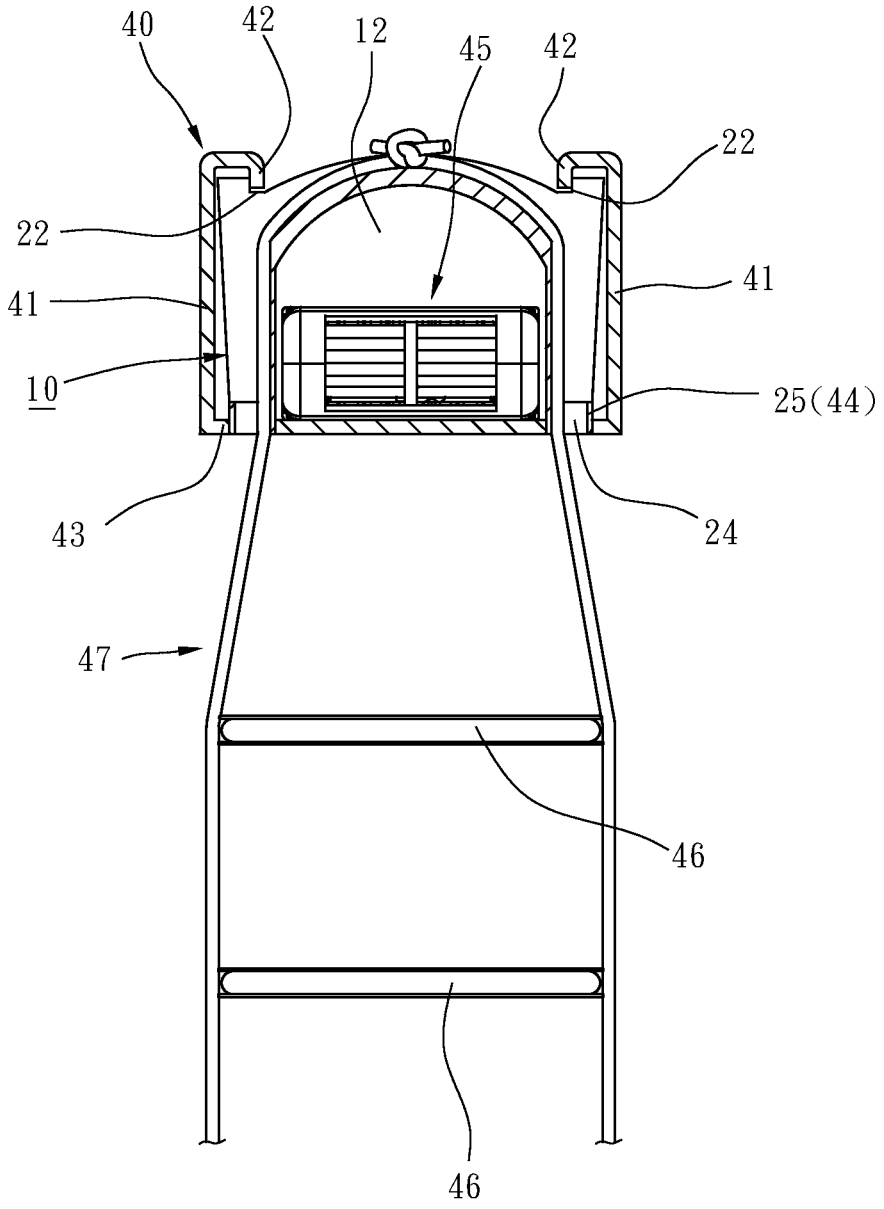
FIG. 3 is a sectional view of the ladder cord fastening seat of the present invention, primarily showing the ladder cord fastening seat is installed in a top beam and the condition that slats are not turned yet.

Referring to FIG. 3, a top beam 40 shown in the figure has two lateral plates 41 located opposite to each other and a bottom plate 43 connecting the two lateral plates 41. Each of the two lateral plates 41 is provided at the top end thereof with a protruded edge 42. The bottom plate 43 is provided at the middle thereof with two positioning holes 44 opposite to each other. Besides, there is a cord rolling device 45 disposed in the top beam 40. Owing that the cord rolling device 45 is conventional and not the key point of the invention, the detailed configuration and operational theorem thereof will not be repeatedly mentioned hereunder for economy of space.

Figure 1:
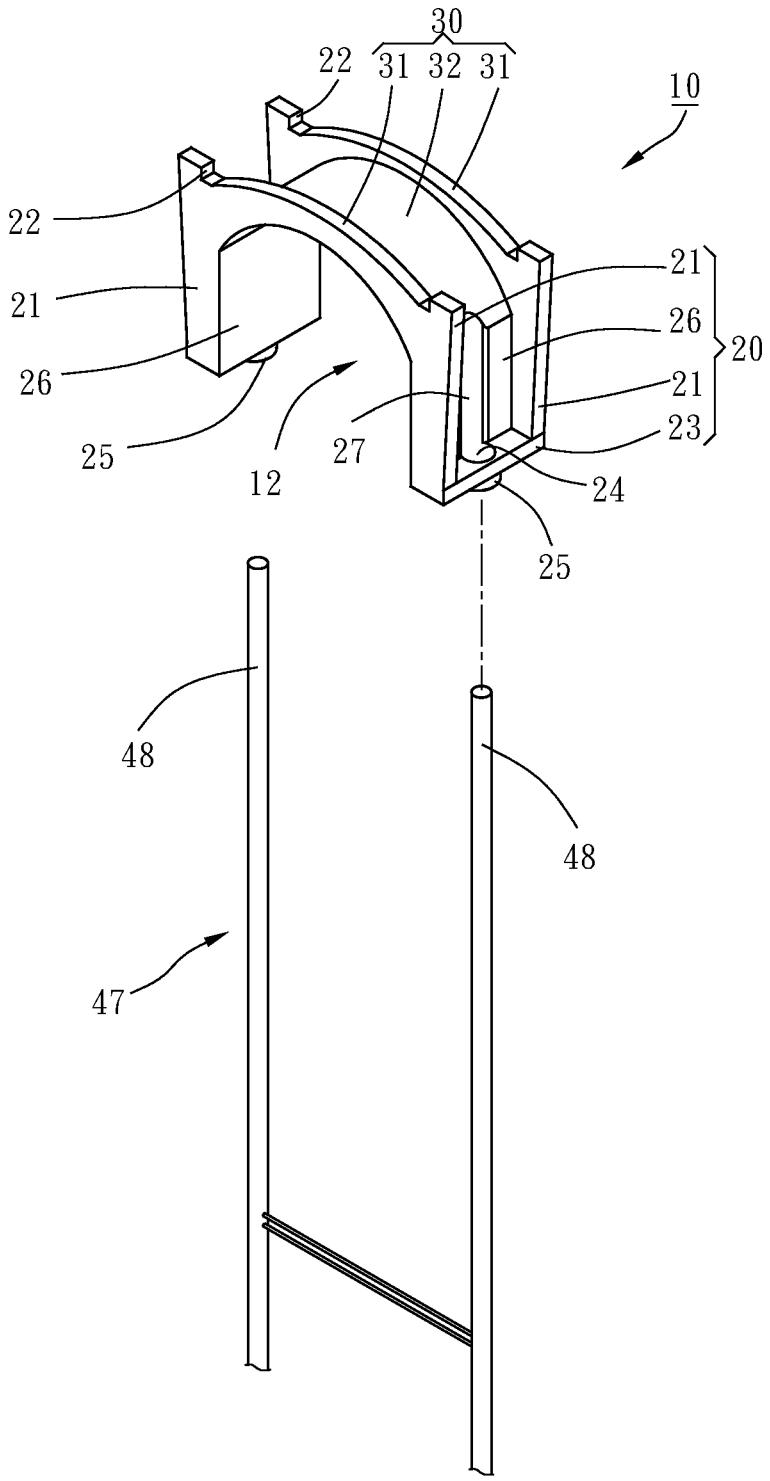
FIG. 1 is an exploded perspective view of a ladder cord fastening seat along with a ladder cord of the present invention.

Referring to FIG. 1, a ladder cord fastening seat 10 of the present invention includes two vertical posts 20 located opposite to each other and an arc bridge 30.

Each of the vertical posts 20 has two positioning walls 21 located opposite to each other, a bottom wall 23, and an end wall 26. Each of the positioning walls 21 is provided on a top end thereof with a positioning recess 22. The bottom wall 23 connects bottom ends of the two positioning walls 21 and has a cord inserting hole 24 cut through top and bottom surfaces of the bottom wall 23. The bottom wall 23 is further provided on the bottom surface thereof with a positioning protrusion 25 which is hollow-shaped and communicates with the cord inserting hole 24. The end wall 26 connects the two positioning walls 21 and the bottom wall 23 and has a guiding groove 27. The bottom end of the guiding groove 27 directively communicates with the cord inserting hole 24 of the bottom wall 23.

The arc bridge 30 has two first bridging portions 31 located opposite to each other and a second bridging portion 32. Each of the first bridging portions 31 connects the positioning walls 21 of the two vertical posts 20. The second bridging portion 32 connects the two first bridging portions 31, and two ends of the second bridging portion 32 are connected with the top ends of the end walls 26 of the two vertical posts 20 respectively, so that an accommodation space 12, which is arch-shaped, is jointly defined by the two vertical posts 20 and the arc bridge 30. Besides, the top surfaces of the first bridging portions 31 of the arc bridge 30 are located higher than the top surface of the second bridging portion 32.

When being installed in the top beam 40, as shown in FIGS. 1 and 3, the ladder cord fastening seat 10 is installed in the top beam 40 in a way that the positioning recesses 22 of the positioning walls 21 of the vertical posts 20 are engaged with the protruded edges 42 of the lateral plates 41 of the top beam 40, and the positioning protrusions 25 of the bottom walls 23 of the vertical posts 20 each are inserted in the positioning holes 44 of the bottom plate 43 of the top beam 40 to let the cord inserting holes 24 of the vertical posts 20 communicate with the positioning holes 44 of the top beam 40. Therefore, the installation of the ladder cord fastening seat 10 and the top beam 40 is finished.

Figure 2:
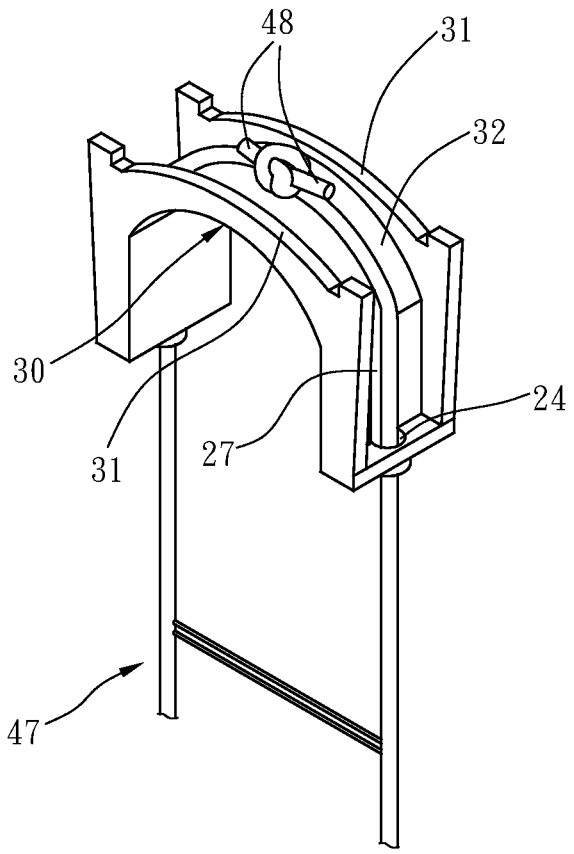
FIG. 2 is an assembled perspective view of the ladder cord fastening seat along with the ladder cord of the present invention.
Figure 4:
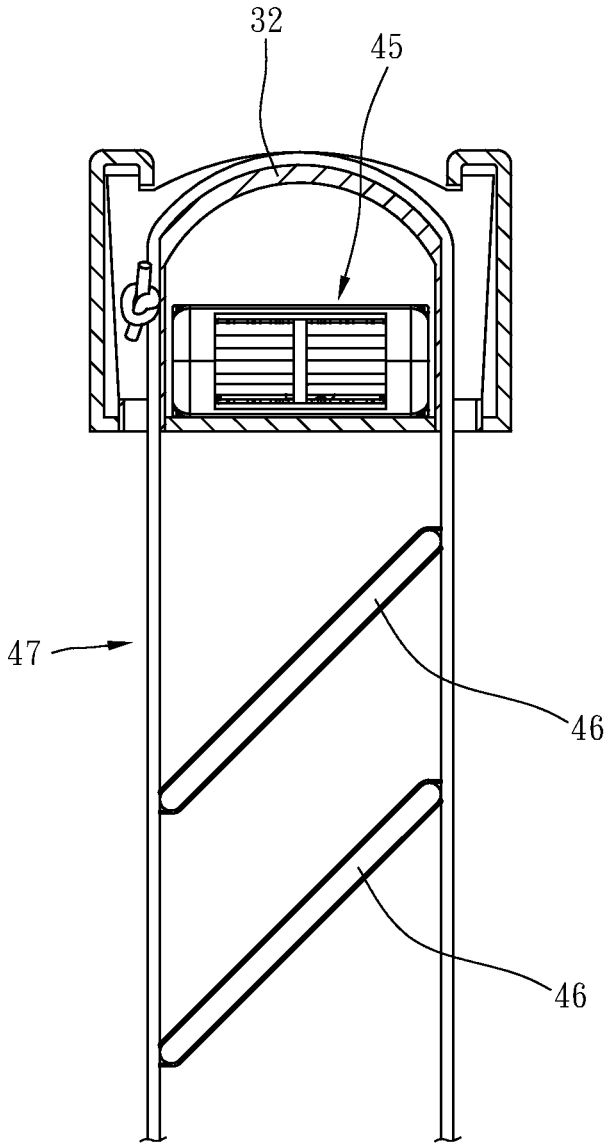
FIG. 4 is similar to FIG. 3, primarily showing the condition that the slats are turned.

Owing that the cord rolling device 45 is usually disposed at the middle of the top beam 40, the ladder cord fastening seat 10, after being installed in the top beam 40, can crossover the cord rolling device 45 and the accommodation space, which is defined by the two vertical posts 20 and the arc bridge 30, can be utilized to accommodate the cord rolling device 45. After that, as shown in FIGS. 2-3, two ends 48 of a ladder cord 47 are inserted through the cord inserting holes 24 of the vertical posts 20 from the positioning holes 44 of the top beam 40, and then pulled to the top surface of the second bridging portion 32 of the arc bridge 30 along the guiding grooves 27 of the vertical posts 20 respectively. At last, the two ends 48 of the ladder cord 47 are tied together by knotting or other fastening ways. At this time, owing to the height difference between the first bridging portions 31 and the second bridging portion 32 of the arc bridge 30, the two ends 48 of the ladder cord 47 will not escape from the are bridge 30. As a result, as shown in FIGS. 3-4, the ladder cord 47 can slide along the second bridging portion 32 of the arc bridge 30. During the sliding, the ladder cord 47 will not interference with the cord rolling device 45, thereby the ladder cord 47 is able to change the turning angle of slats 46 successfully.

It can be understood from the above illustration that the ladder cord fastening seat 10 of the invention can avoid interference with the cord rolling device 45 disposed in the top beam 40 by means of the arch-shaped accommodation space 12 defined by the specific structure of the ladder cord fastening seat 10, enabling the ladder cord 47 to be installed at the middle of the window blind successfully without interfering the existed structure of the window blind. In this way, the ladder cord 47 can work with left and right ladder cords at the same time to turn the slats 46, making the turning of the slats 46 more positively and stably.

What is claimed is:

1. A ladder cord fastening seat for a non-pull window blind, the ladder cord fastening seat comprising:

two vertical posts being located opposite to each other, each of the two vertical posts having a cord inserting hole; and an arc bridge connecting top ends of the two vertical posts in such a way that an accommodation space is defined by the two vertical posts and the arc bridge;

wherein each of the vertical posts has two positioning walls located opposite to each other, a bottom wall, and an end wall; wherein a positioning recess is defined in a top end of each of the positioning walls in the vertical posts; the bottom wall connects bottom ends of the two positioning walls and has said cord inserting hole; the end wall connects the two positioning walls and the bottom wall; the arc bridge has two first bridging portions located opposite to each other and a second bridging portion connecting the two first bridging portions; each of the first bridging portions integrally connects two of the positioning walls of the two vertical posts respectively; the second bridging portion integrally connects the end walls of the two vertical posts.

2. The ladder cord fastening seat as claimed in claim 1, wherein each of the vertical posts is provided on a bottom surface thereof with a positioning protrusion which is hollowed and communicates with the cord inserting hole.

3. The ladder cord fastening seat as claimed in claim 2, wherein the bottom wall has said cord inserting hole and said positioning protrusion.

4. The ladder cord fastening seat as claimed in claim 1, wherein top surfaces of the first bridging portions are higher than a top surface of the second bridging portion.

5. A ladder cord fastening seat for a non-pull window blind, the ladder cord fastening seat comprising:

two vertical posts being located opposite to each other, each of the two vertical posts having a cord inserting hole; and an arc bridge connecting top ends of the two vertical posts in such a way that an accommodation space is defined by the two vertical posts and the arc bridge;

wherein each of the vertical posts has a guiding groove communicating with the cord inserting hole; and wherein each of the vertical posts has two positioning walls located opposite to each other, a bottom wall, and an end wall; the bottom wall connects bottom ends of the two positioning walls, and has said cord inserting hole; the end wall connects the two positioning walls and the bottom wall and has said guiding groove; the arc bridge has two first bridging portions located opposite to each other and a second bridging portion connecting the two first bridging portions; each of the first bridging portions integrally connects two of the positioning walls of the two vertical posts respectively; the second bridging portion integrally connects the end walls of the two vertical posts.

6. A ladder cord fastening seat for a non-pull window blind, the ladder cord fastening seat comprising:

two vertical posts being located opposite to each other, each of the two vertical posts having a cord inserting hole; and an arc bridge connecting top ends of the two vertical posts in such a way that an accommodation space is defined by the two vertical posts and the arc bridge;

wherein each of the vertical posts is provided on a bottom surface thereof with a positioning protrusion which is hollowed and communicates with the cord inserting hole;

wherein each of the vertical posts has a guiding groove communicating with the cord inserting hole; and wherein each of the vertical posts has two positioning walls located opposite to each other, a bottom wall, and an end wall; wherein a positioning recess is defined in a top end of each of the positioning walls in the vertical posts; the bottom wall connects bottom ends of the two positioning walls and has said cord inserting hole and said positioning protrusion; the end wall connects the two positioning walls and the bottom wall and has said guiding groove; the arc bridge has two first bridging portions located opposite to each other and a second bridging portion connecting the two first bridging portions; each of the first bridging portions integrally connects two of the positioning walls of the two vertical posts respectively; the second bridging portion integrally connects the end walls of the two vertical posts.

* * * * *